United States Patent [19]

Rhine

[11] Patent Number: 4,632,273

[45] Date of Patent: Dec. 30, 1986

[54] DISPOSABLE INSULATED CONTAINER

[75] Inventor: Richard Rhine, Carthage, Mo.

[73] Assignees: Ellen M. Rhine, Carthage, Mo.; Mary R. Streets, Overland Park, Kans.

[21] Appl. No.: 773,311

[22] Filed: Sep. 6, 1985

[51] Int. Cl.[4] ..... B65D 41/16

[52] U.S. Cl. ..... 220/411; 220/3.1; 215/1 C; 215/DIG. 7

[58] Field of Search ..... 220/411, 412, 3.1, 23, 220/23.83, 23.86; 215/1 C, DIG. 7, 246

[56] References Cited

U.S. PATENT DOCUMENTS

| | | | |
|---|---|---|---|
| 896,903 | 8/1908 | Ferry | 215/DIG. 7 X |
| 1,261,450 | 4/1918 | Smith . | |
| 1,282,514 | 10/1918 | Wooden . | |
| 1,427,259 | 8/1922 | Burton . | |
| 2,790,576 | 4/1957 | Lawrence . | |
| 3,032,224 | 5/1962 | Lou . | |
| 3,079,630 | 3/1963 | Orr . | |
| 3,227,301 | 1/1966 | Cornelius | 215/DIG. 7 X |
| 3,244,313 | 4/1966 | Miles . | |
| 3,341,045 | 9/1967 | Sandler . | |
| 3,362,556 | 1/1968 | Waldrum | 215/1 C |
| 3,595,464 | 7/1971 | Harrison . | |
| 4,014,456 | 3/1977 | Echtie . | |
| 4,230,230 | 10/1980 | Mumford | 215/DIG. 7 X |
| 4,513,895 | 4/1985 | Leslie | 220/3.1 X |
| 4,544,073 | 10/1985 | Willis | 215/246 |

FOREIGN PATENT DOCUMENTS

| | | | |
|---|---|---|---|
| 560632 | 4/1975 | Switzerland | 215/DIG. 7 |

*Primary Examiner*—Steven M. Pollard

*Attorney, Agent, or Firm*—Wood, Herron & Evans

[57] ABSTRACT

A disposable insulated container and drinking cup combination wherein the insulated container is manufactured from plastic foam material and has a lid applied thereto. At least one inverted drinking cup mounted upon the top of the container with the cup, container, and lid sealingly secured in a package by a frangible ring encircling the lower edge of the inverted drinking cup and the periphery of the container.

7 Claims, 3 Drawing Figures

DISPOSABLE INSULATED CONTAINER

This invention relates to insulated beverage containers and more particularly to a disposable insulated beverage container and cup combination.

Traditionally, hot beverages, such as hot coffee, have been transported and stored in vacuum bottles, a two-ply container wherein there is a vacuum between the two plies of the container. Such portable containers are very effective for maintaining a beverage at a fixed or substantially fixed temperature for a relatively long period of time, but this type of container is expensive and cannot practically be used as a disposable item.

A less expensive alternative to a vacuum bottle for storing and transporting heated beverages is a container made from two plies of plastic separated by a foam plastic filler. Such a two-ply plastic and foam container is disclosed in U.S. Pat. No. 3,032,224. Even this type of container, though, is too expensive to be practical as a disposable item intended for only a single usage.

In the absence of a relatively expensive vacuum bottom or a foam filled multi-ply plastic container, hot beverages have traditionally been transported in polystyrene foam plastic cups. Such cups, though, do not maintain the temperature of the hot liquid stored therein for prolonged periods of time. Consequently, a person purchasing more than a single cup of a hot beverage, such as coffee, in a polystyrene foam plastic cup must consume the total quantity of coffee within a relatively short time because the beverage will lose its heat and become insipidly cool in a relatively short time.

There has therefore been a longstanding need for an alternative to a relatively expensive vacuum bottle or a polystyrene foam cup which would store and maintain the temperature of a hot beverage for a substantially long period, but which would still be practical as a disposable item. It has therefore been an objective of this invention to provide an inexpensive disposable insulated container for the storage and transport of heated beverages.

One criteria for a disposable heat insulated container is that it should have an insulated top, and that top should preferably be permanently sealed to the container until the container is placed in use. If the top is so sealed, a person using the container need not worry about whether the container has been previously used or contaminated. It has therefore been another objective of this invention to provide a disposable inexpensive insulated container which includes an insulated top permanently sealed to the container until the container is ready to be used.

Vacuum bottles have traditionally included a drinking cup as an attachment to the bottle to facilitate drinking from it. Such cups often take the form of a lid or a cap of the bottle and in other cases, of an attachment which may be placed over the top of the lid and secured thereto as in U.S. Pat. No. 1,261,450. A disposable and sealed insulated container should also preferably include a drinking cup sealed thereto as a part of, or attachment to, the container. It has therefore been another objective of this invention to provide an inexpensive insulated beverage container wherein a drinking cup forms an attachment to the container and wherein the cup is sealed thereto until the container is ready to be placed in use.

The disposable insulated container of this invention which accomplishes these objectives comprises a sealed package of container manufactured from plastic foam, a lid preferably also manufactured from plastic foam, and a drinking cup mounted atop the container. In one preferred embodiment, a foam plastic insulated lid has a bottom section press fit into the open top of the container and an upwardly and inwardly tapered upper section. One or more inverted drinking cups are mounted atop the insulated lid with the innermost cup having a tapered surface mating with the tapered surface of the lid. In another embodiment, a snap-fit lid is secured to the top of the container and one or more foam plastic cups mounted atop the container over the snap-on lid. In both embodiments, a frangible plastic ring sealingly secures the lower edge of the inverted cup or cups to the top of the container with the lid of the container immovably entrapped on the open top of the container. To use the container, the frangible plastic ring must be broken so as to enable the cup and lid to be removed. When the lid and cup are replaced on the container, the resiliency of the plastic is sufficient to maintain the lid and cups in place on the container even if the container is full of liquid and tipped to a horizontal or even an inverted position.

These and other objects and advantages of this invention will become more readily apparent from the following description of the drawings in which.

Figure 1:
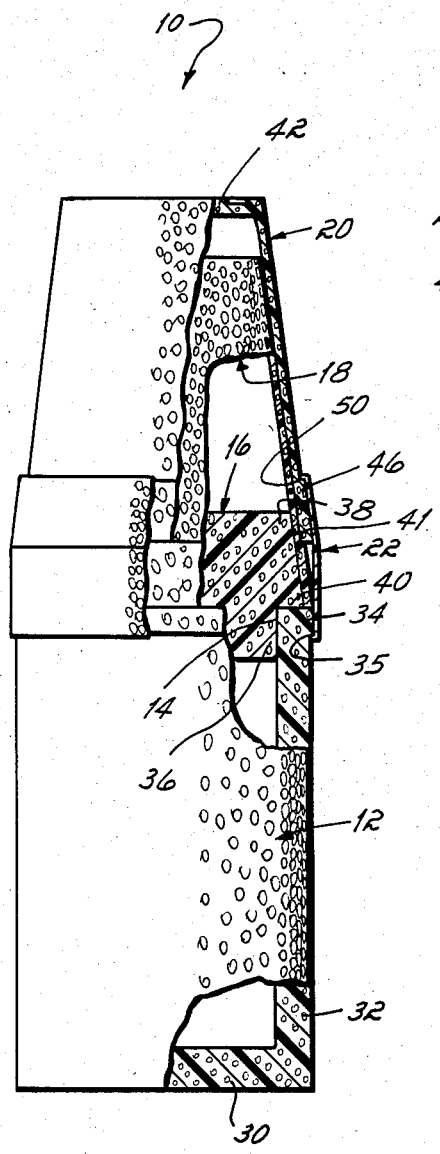
FIG. 1 is a side elevational view, partially broken away, of a disposable insulated container incorporating the invention of this application.
Figure 2:
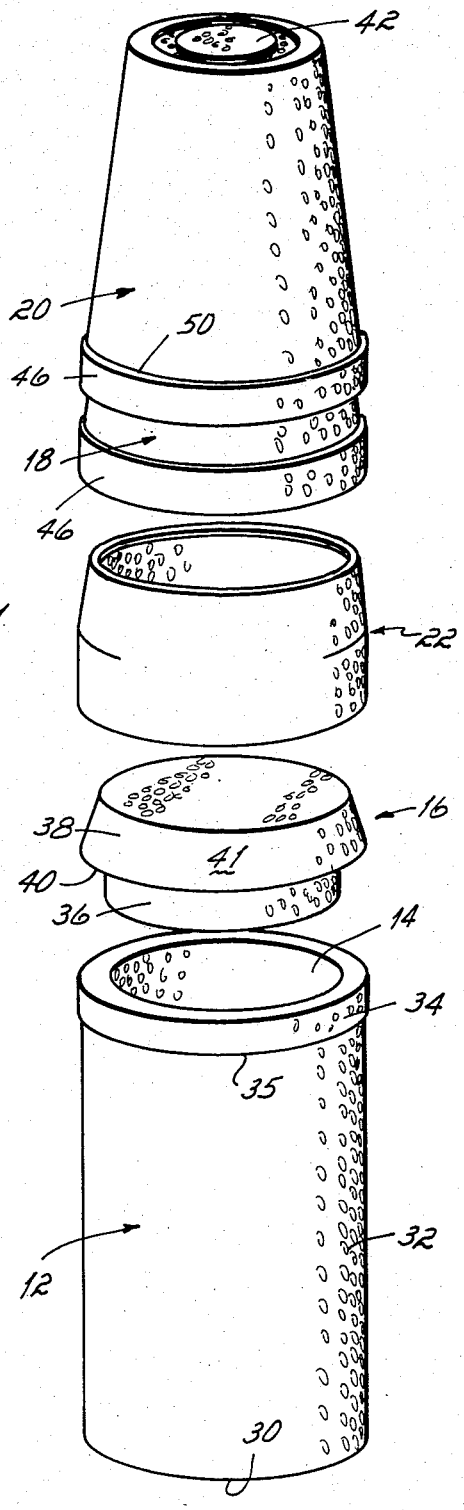
FIG. 2 is an exploded perspective view of the container of FIG. 1.

With reference to FIGS. 1 and 2 of the drawings, a first embodiment of the invention of this application is there illustrated. This embodiment is a packaged container 10 which comprises an insulated container 12, the open top 14 of which is closed by an insulated lid 16. Mounted atop this insulated lid there are a pair of nested drinking cups 18 and 20. The insulated container 12, lid 14, and insulated cups 18, 20 are secured in a sealed relationship by a frangible sealing ring 22 which must be broken in order to enable the cups 18, 20 or the lid 14 to be removed from the container 12.

The insulated cup 12 is made from polystyrene foam. It comprises a circular bottom wall 30 and a cylindrical side wall 32. Around the top of the side wall there is an outwardly extending flange 34 which, as explained more fully hereinafter, functions to facilitate sealing interconnection of the cups 18, 20 and the lid 16 to the container 12.

The lid 16 comprises a cylindrical lower section 36 and a tapered upper section 38. It, too, is made from polystyrene foam. The cylindrical lower section of the lid is dimensioned so as to be slightly larger than the open top 14 of the container 12 such that the lower section of the lid may be press fit or forced into the open top 14. The upper tapered section 38 of the lid tapers inwardly and upwardly from a horizontal shoulder 40 which forms the interface between the lower section 36 and the upper tapered section 38 of the lid. This shoulder 40 rests atop the upper edge of the container when the lid is secured onto the top of the container.

The cups 18 and 20 are identical and comprise conventional nestable polystyrene drinking cups. Each cup has a bottom wall 42 from which a side wall tapers outwardly and terminates in a flange 46 which surrounds the open end of the cup. A shoulder 50 of this flange cooperates with the sealing ring 22 to sealingly secure the drinking cups to the container 12.

The two cups 18 and 20 are nested one within the other with the open end of the innermost cup 18 resting atop the tapered upper section 38 of the lid. The tapered wall 41 of the upper section of the lid is tapered at the same angle as the taper on the side walls of the cups. In one preferred embodiment of the invention, the taper is approximately 8° from a vertical plane through the walls and/or the lid.

The outer diameter of the lid and the inside diameter of the cups are preferably dimensioned such that when the cups are placed on top of the lid, the cups and the lid are press fit or slightly compressed. Thereby, even without the presence of the sealing ring 22, the cups may be retained on top of the lid when the complete assemblage is inverted or turned upside down.

To sealingly secure the container 12, the lid 16, and the cups 18 and 20 in an assembled package 10, the frangible plastic ring 22 is placed over the flange 46 of the uppermost cup and the flange 34 of the container 12. The lower edge of the ring 22 is turned inwardly and engaged with the shoulder 35 of the cup, and the upper edge of the sealing ring is turned inwardly and engaged with the shoulder 50 of the outermost cup 20. In one preferred embodiment, the sealing ring 22 is manufactured from polysytrene foam. Alternatively, the sealing ring may be made from a heat shrinkable plastic film and shrunk onto the assembled container 12, lid 14 and cups 18 and 20. The presence of the sealing ring 22 insures that the cups cannot be removed from the lid 14 or the lid from the container 12 without first breaking the frangible ring 22. The seal then insures the user that the container and the cup have never been used before and are sanitarily clean.

In the use of the packaged container 10, the complete package is maintained in a closed and sealed relationship until the container is ready to be filled with a liquid product, as for example, coffee at a temperature on the order of 120° F. This is the preferred temperature at which coffee is generally served. To open the package, the frangible ring 22 is broken and the cups removed from the top of the lid 14. The lid 14 is then removed from the container 12 so as to expose the sanitary and clean interior surface of the container 12. The container 12 is then filled with coffee or liquid and closed by forcing the lower section 36 of the lid down back into the open top 14 of the container. The resiliency of polystyrene foam is such that the lid may be forced back into the open top of the container and retained thereon even when the container and coffee are turned upside down. Similarly, the drinking cups 18 and 20 may be forced downwardly onto the tapered surface 41 of the lid with sufficient force that the cups will be retained on the lid when the complete assembly is turned upside down. The advantage of press fitting the lid into the open top of the container and the cups onto the top of the lid is that the complete package will be retained in an assembled relationship in the event of an accident in which the package is inadvertently turned over or turned onto its side. The resiliency of polystyrene foam is such that it has been found that the lid may be removed and replaced on the container 12 several times before the foam loses sufficient resiliency that the lid will no longer be retained on the container in the event that the container and lid are inadvertently turned over or upset.

Figure 3:
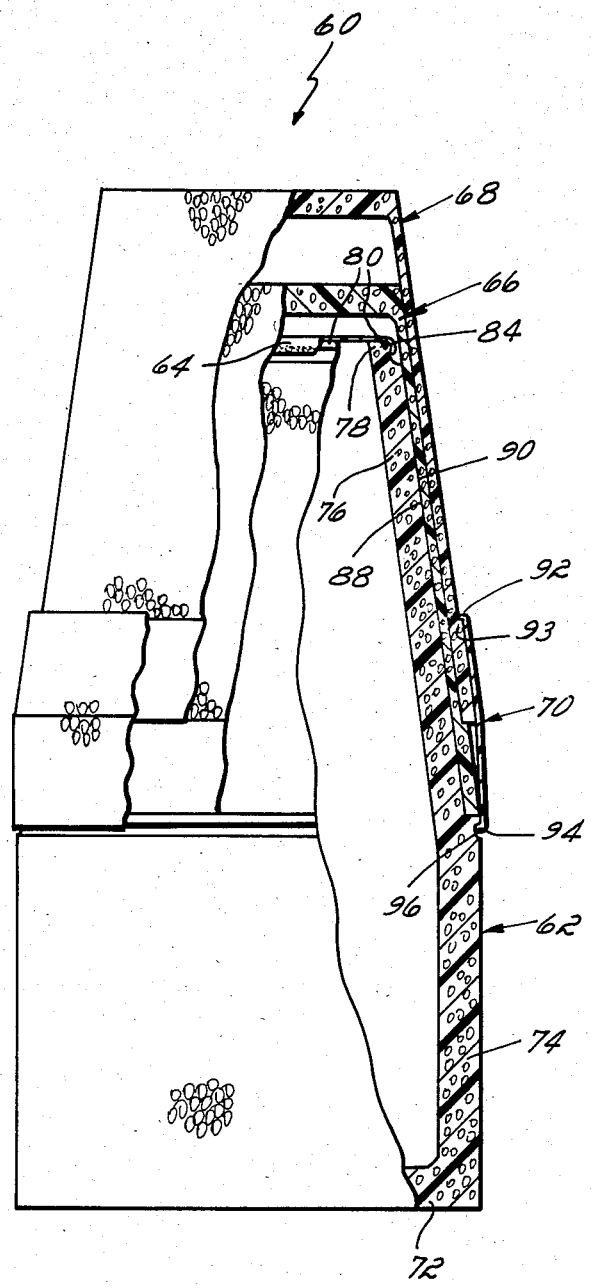
FIG. 3 is a side elevational view, partially broken away, of a second embodiment of a disposable insulated container incorporating the invention of this application.

With reference now to FIG. 3, there is illustrated a second embodiment of the invention of this application. In this embodiment, as in the first embodiment, the packaged container 60 comprises a foam plastic container 62, a lid 64, two foam palstic cups 66, 68, and ring 70 for sealingly securing the cups to the top of the container 62.

The container 62 is manufactured from a foam plastic, such as foam polystyrene. It comprises a round bottom 72 from which there extends upwardly a cylindrical side wall 74 having an inwardly tapered upper section 76. The upper edge 78 of the container 62 has a lip 80 formed thereon for the reception of the lid 64.

The lid 64, rather than being manufactured from foam plastic as in the first embodiment, is manufactured from a plastic film which is vacuum formed so as to have an outer edge 84 which may be snap fit over the lip 80 of the container so as to secure the lid thereon. The lid may be manufactured from any plastic film subject to vacuum forming or forming into a semi-rigid configuration amenable to being snap fit over the lip of the container and thereby secured thereon.

The cups 66, 68 are identical to the cups 18, 20 of the first embodiment, except that they may be sized differently so as to enable them to fit over and engage the inwardly tapered peripheral wall 88 of the container 62. As in the first embodiment, the cups are inverted when they are placed over the top of the container. In this embodiment, though, rather than having the inside wall of the innermost cup rest against the tapered wall of the lid, the inside wall 90 of the innermost cup rests against the matingly tapered exterior wall 88 of the container. Thereby, the complete package 60 of container and cups is made substantially smaller than in the first embodiment. In many instances this will be preferable because of the reduced cost involved in transporting the smaller packaged product.

As in the first embodiment of the invention, the cups are sealingly secured to the container 62 by means of a frangible sealing ring 70. The sealing ring 70 is identical to the sealing ring 22 of the first embodiment, except for a size differential. As in the first embodiment, the sealing ring has an upper lip 92 which engages a shoulder 93 of the cup. It also has a lower lip 94 which engages an annular groove or shoulder 96 in the periphery of the container so as to sealingly secure the cups to the container.

In the use of the embodiment of FIG. 3, the frangible sealing ring 70 is broken so as to enable the cups and lid to be removed from the container 62. Thereby, a sanitary and clean cup interior is assured. Upon removal of the lid 64, the cup is filled with a beverage after which the lid 64 is snap fit onto the open top of the container. The cups 66, 68 are then replaced atop the container. Because of the inherent resiliency of the foam plastic of which the cups and container 62 are manufactured and the relative coefficients of friction between the container and the interior of the cups, the cups will remain secured onto the container even if the complete package, without the presence of the seal 70, is turned upside down. Preferably, the snap fit connection between the lid and the lip of the container is sufficiently secure and sufficiently sealed that if the container is tipped or turned over, the coffee or beverage contained in the container will not spill.

One of the advantages of both embodiments of the packages 10, 60 of insulated container, lid and cups is that it may be used with relative certainty that the container 12 is clean and has not been contaminated. Preferably, a person using the cup is the one who breaks the frangible sealing ring 22, 70 and therefore is assured of the cleanliness of the inside of the container 12, 62, as well as the inside of the cups 18, 20 and 66, 68. The package also has the advantage, in addition to cleanliness, of being inexpensive so that after a single use it may be thrown away or discarded.

While I have described only two preferred embodiments of my invention, persons skilled in this art will appreciate changes and modifications which may be made without departing from the spirit of my invention. Therefore, I do not intend to be limited except by the scope of the following appended claims.

I claim:

1. A disposable insulated container and drinking cup combination, said combination comprising an insulated container manufactured from plastic foam material, said container having a closed bottom, a side wall, and an open top, an insulated manufactured from plastic foam material, said lid having a top section, a bottom section, and a shoulder at the intersection of said top and bottom sections, said bottom section being press fit into the open top of said container with said shoulder being engaged with the top edge of said side wall of said container, at least a portion of said lid having an upwardly and inwardly tapered peripheral surface, at least one inverted drinking cup mounted upon the top of said lid, said drinking cup having an inner tapered surface engaged with said tapered surface of said lid, and securement means for sealingly securing said cup, lid and container in an assembled relationship, said cup and lid being removable from said container only upon breakage and removal of said securement means from said combination.

2. The combination of claim 1 wherein said securement means comprises a frangible plastic ring engageable with said cup and said container.

3. The combination of claim 2 wherein said ring and said cup are both manufactured from foam plastic material.

4. The combination of claim 1 wherein said container has a peripheral flange extending from the side wall thereon and said drinking cup having a peripheral flange formed thereon, said securement means comprising a plastic ring extending between and wrapping over said flanges so as to lock and seal said cup to said container.

5. The combination of claim 4 wherein said plastic ring and said cup are both manufactured from foam plastic.

6. A disposable container and drinking cup combination, said combination comprising an insulated container manufactured from plastic foam material, said container having a closed bottom, a side wall, and an open top, a lid secured to the top of said container, at least one of said lid and said container having an outer tapered surface, at least one inverted drinking cup mounted upon the top of said container, said drinking cup having an inner tapered surface matingly engaged with said tapered surface of said one of said lid and container, said container having a peripheral flange extending from the side wall thereof and said drinking cup having a peripheral flange formed thereon, and securement means comprising a plastic ring extending between and wrapping over said flange for sealingly securing said cup, lid and container in an assembled relationship, said cup and lid being removable from said container only upon breakage and removal of said securement means from said combination.

7. The combination of claim 6 wherein said plastic ring and said cup are both manufactured from foam plastic.

* * * * *